US005845354A

United States Patent [19]

Long et al.

[11] Patent Number: 5,845,354

[45] Date of Patent: Dec. 8, 1998

[54] MULTIPURPOSE HOUSE AND SHOP TOOL

[76] Inventors: Joseph F. Long, 1335 Lost Creek Rd.; Thomas A. Harlan, 8800 Feather Hill Rd., both of Austin, Tex. 78703

[21] Appl. No.: 896,567

[22] Filed: Jul. 18, 1997

Related U.S. Application Data

[63] Continuation-in-part of Ser. No. 688,635, Jul. 29, 1996.

[51] Int. Cl.[6] ..... B25D 1/04

[52] U.S. Cl. ..... 7/139; 7/143; 7/166

[58] Field of Search ..... 7/139, 143, 151, 7/165, 166; 81/143, 154, 439, 437, 141, 142, 150, 20

[56] References Cited

U.S. PATENT DOCUMENTS

| | | | |
|---|---|---|---|
| 404,001 | 5/1889 | Heacock | 7/139 |
| 439,336 | 10/1890 | Zitlow | 7/138 |
| 566,655 | 8/1896 | Campbell | 7/139 |
| 780,305 | 1/1905 | Riggins | 7/139 |
| 1,158,713 | 11/1915 | Nymon | 81/154 |
| 1,183,733 | 5/1916 | Hulthin | 81/154 |
| 1,729,795 | 10/1929 | North | 81/143 |
| 2,596,594 | 5/1952 | Petre | 81/439 |
| 2,658,766 | 11/1953 | Rock | 81/439 |
| 4,028,969 | 6/1977 | Politte | 7/139 |
| 5,280,659 | 1/1994 | Park | 7/139 |

*Primary Examiner*—David A. Scherbel
*Assistant Examiner*—Lee Wilson
*Attorney, Agent, or Firm*—Joseph F. Long

[57] ABSTRACT

A multipurpose tool useable to open container caps, to hammer nails, to pull nails, to act as a screw driver, to loosen and tighten a nut, to open bottle caps, to pry off lids, to act as s vice grip tool and to act as a C clamp.

3 Claims, 3 Drawing Sheets

MULTIPURPOSE HOUSE AND SHOP TOOL

This is a continuation -in-part of Ser. No. 08/688,635, filed Jul. 29, 1996 and entitled a "Multipurpose House and Shop Tool" by inventors J. F. Long and T. A. Harlan.

BACKGROUND

This invention differs from the parent patent in that an improved mechanism allows the user to adjust the jaws forcibly together with the jaws being held in place to allow use of the tool as vice grips, and as a small portable vice or clamp. The design has been further improved to facilitate manufacturing.

There is a need for many different tools at various times around a normal household. This tool has been designed in itself to serve many functions and may be used for any of the following purposes:

- to loosen a threaded or breachlock type closure from about one half to over four inches in diameter;
- to pull a nail or to pry open a lid such as that normally found on jelly jars;
- to drive a tack or a nail;
- to pull a nail;
- to pry objects apart;
- to install or remove an average size Phillips or a slotted channel screw;
- to loosen or tighten a nut on a bolt;
- to grip a pipe or bolt to allow removal of a nut or fitting using a second wrench or pliers;
- to act as a C clamp; and
- to cut and strip small wires.

We realize that many minor modifications to this invention can be made and we wish only to be limited to purpose and spirit as outlined in these specifications and claims.

BRIEF SUMMARY OF THE INVENTION

This invention may be described as a multipurpose tool specifically designed to do many simple jobs. In a preferred embodiment the upper head is designed to use as a hammer and to pull nails or pry off caps. A lower head or sliding section may be easily pushed against the upper head and with a material between the lower section and the matching lower face of the hammer or upper head the material is squeezed and held in place with a vice type action by the manually operable locking mechanism in the lower section. The upper head is fastened rigidly to a hollow shaft or handle and the lower section slides on this hollow shaft. This hollow shaft which may be square, oblong, or oval in cross section with square being preferable. This hollow shaft is knurled or corrugated on one side to allow operability of the locking mechanism which uses a triangular piece to lock in place to cause the lower section to try to move upward as a lockhead or threaded pin with an angled or cone shaped face is screwed downward against the triangular piece. The hollow end of the shaft is closed with a special fitting to hold short segments of screw driver fittings and is held in place with a spring loaded push button. This segment is reversible to be used also to hold a socket from a socket wrench set. Other small tools such as a nail punch to use for starting screws and a line level are also stored in the handle or shaft.

DETAILED DESCRIPTION OF THE INVENTION

Figure 1:
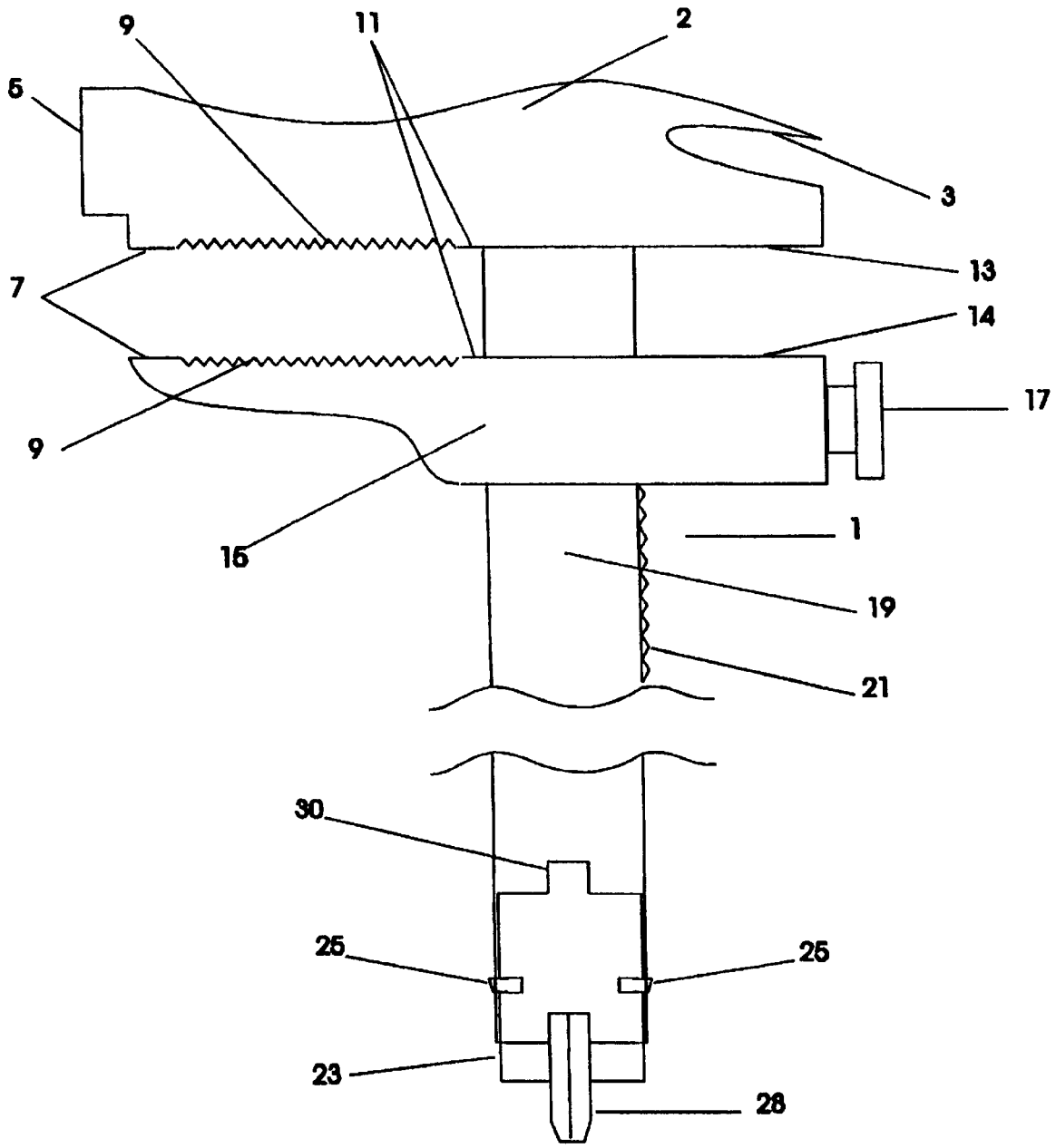
FIG. 1 shows a side view of the multipurpose tool.

In FIG. 1 a side view of the unit 1 is shown. Shaft 19 is preferably 10 to 12 inches long and preferably has a rectangular cross section that measures about ¾ by ¾ inches. Shaft 19, upper head 2 with hammer face 5 and the lower slidable head or section 15 are preferably fabricated from a stainless steel but other metals would be satisfactory. Shaft 19 may be rigidly fastened to upper head 2 by welding , pinning, or shrink fitting. Tines 3 are shaped for pulling a nail or other prying operations. The lower face of head 2 on one side has very fine gripping teeth 7 on the tip followed by teeth 9 that are a minimum of ⅛ inch in height with a portion 11 for wire cutting near the shaft 19. Matching teeth 7 and 9 and matching wire cutter 11 are on the top face of the lower slidable section 15. On the opposite side of the shaft 19 both the lower face 13 of the upper head 2 and the upper face 14 of the lower section 15 are smooth so that the tool may be used much like a normal crescent wrench. When a material is placed between upper head 2 and lower section 15 and section 15 is pushed tightly against the material, tightening the threaded pin or knurled lock head 17 will grip the material very tightly and lock in place since the section 15 will move upward as much as about 3⁄16 of an inch and lock in place at any place in the upward travel. The locking mechanism is explained in FIG.4.

At the lower end of shaft 19 a special fitting 23 designed to removably and usably hold screw driver tips 28 is held in place with a spring loaded push button 25. The special fitting 23 may be reversed so that tip 30 may be used to connect with a socket. The hollow shaft 19 will be used to store screw driver tips for both slotted and Phillips head screws and a nail set to use to also start screws and a line type level (not shown).

Figure 2:
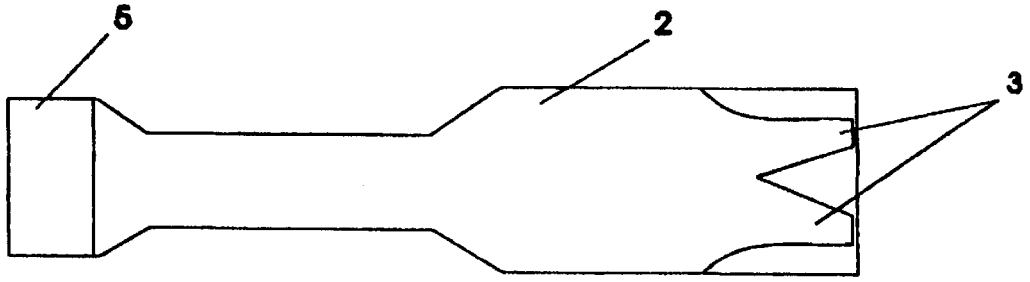
FIG. 2 shows a top view of the unit.

In FIG.2 a top view of upper head 2 indicating the shape of hammer face 5 and nail pulling or prying tines 3 is shown.

Figure 3:
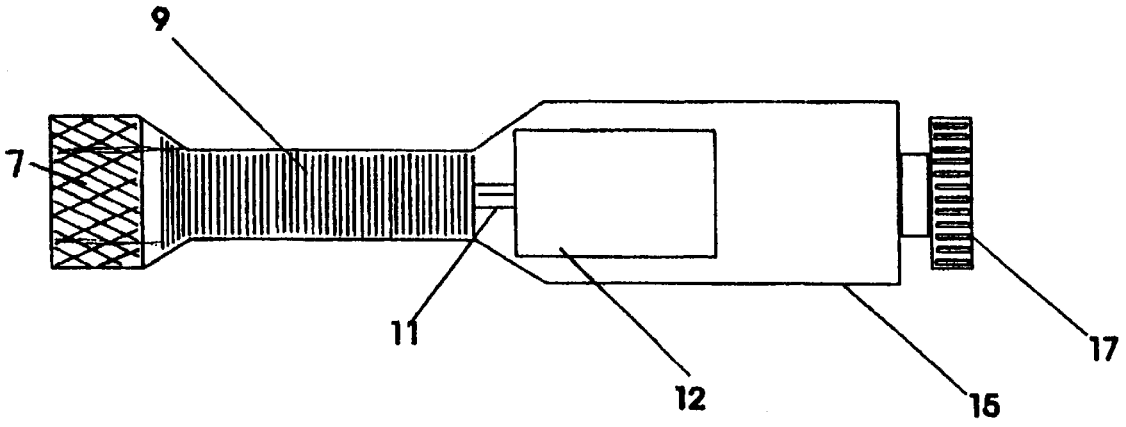
FIG. 3 shows a top view of the lower sliding section of the unit.

In FIG.3 the upper side of the lower slidable head or section 15 is shown. Opening 12 is sized to fit closely but slidably around shaft 19, FIG. 1. Teeth 7 and 9 and one side of wire cutter 11 are as previously described under FIG. 1. The function of the knurled lock head 17 and associated mechanism to form a tightening and locking mechanism is further described under FIG.4.

Figure 4:
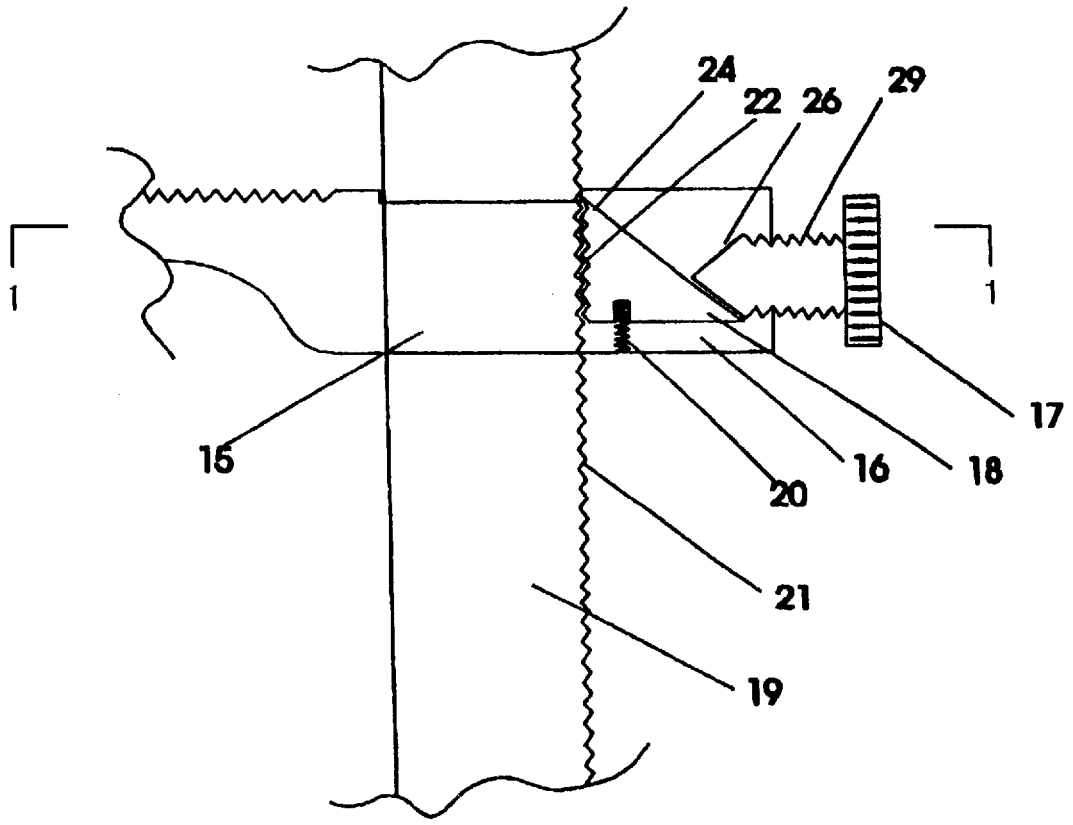
FIG. 4 shows a side detail view of the locking mechanism in the lower sliding section of the unit.

In FIG. 4 an end segment of the lower sliding section 15 is shown as it would slide on shaft 19. Corrugations or knurling 21 on shaft 19 may be quite small and conventional knurling is sufficient to cause triangle 18 with knurling 22 on the bottom of the triangle 18 to lock in place when face 26 of lock head 17 is tightened against the triangle 22. With lock head 17 as shown the spring 20, although quite weak, will push the triangle 18 upward to disengage the triangle from the knurlings on shaft 19. When lock head 17 is screwed inward the triangle 18 locks against the shaft 19 and as force is applied the face 26 travels downward on the triangle face thereby causing the lower head section 15 to move upward and close space 16, thereby tightening and locking the slidable head or lower section 15 against the upper head 2, FIG. 2. For most desirable operation of the unit space 18 should be about 3⁄16 of an inch or greater in width. For optimal operation angle 24 should be about 45 degrees. This gives sufficient mechanical advantage with fine threads 29 for the unit to function as vice grips.

Figure 5:
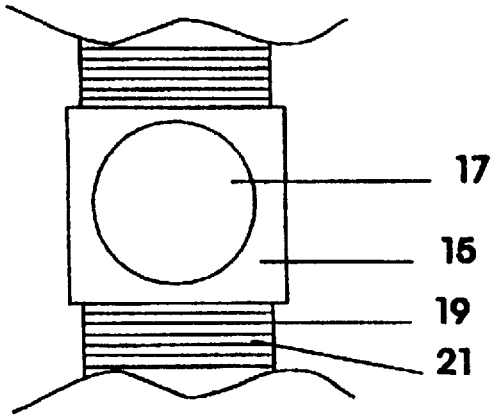
FIG. 5 shows a section 3 . . . 3 of FIG. 4.

FIG. 5 shows section 3 . . . 3 of FIG. 4 shows very fine teeth or knurlings 21 on shaft 19 and relative size of lockhead 17 and the end view of the lower sliding segment 15.

What is claimed is:

1. A multipurpose tool comprising

A) a hollow shaft;

B) corrugations on one side of said shaft;

C) an upper head means rigidly fastened to a first end of said shaft;

D) a lower head means slidable on said shaft;

E) a manually operable locking and tightening means in said lower head means; said locking and tightening means operating to move said lower head means upward to exert an upward force and lock in place when said lower head means is manually held against a rigid material held between said lower head means and said upper head means and a threaded pin in said lower head means is manually tightened;

F) very fine teeth, teeth a minimum of one eigth inch in height and a wire cutting segment, located in a first end of a lower mating face of said upper head means; said very fine teeth being adjacent to said teeth a minimum of one eigth inch in height which are adjacent to an upper side of said wire-cutting segment; said fine teeth, said teeth a minimum of one eigth inch in height, and said wire cutting segment, all having equal height upper surfaces;

G) a smooth second end of said lower mating face located across said shaft from said wire cutting segment and of equal height to said wire cutting segment, H) a second set of very fine teeth, teeth a minimum of one eigth inch in height and a lower wire cutting segment, and a smooth surface forming a mating surface means on said lower head means to match and oppose said very fine teeth, said teeth a minimum of one eigth inch in height, said wire cutter means and said flat surface on said upper head means;

I) a tool holding means removably held in a second end of said shaft;

J) a hammer face a minimum of about one square inch in area formed on a first end of said upper head means; and K) a vee shaped claw means on a second end of said upper head means.

2. A multipurpose tool as in claim 1 wherein said tool holding means has a cavity on a first end sized to hold screw driver segments and a square tip on a second end sized to connect with a wrench socket with said tool means being held in place with spring loaded push buttons.

3. A multipurpose tool as in claim 1 wherein said locking and tightening means comprises a triangular segment with a corrugated base in one end of said lower head; a spring to lightly hold said corrugated base slidably above said shaft; a threaded pin with a flat rounded head and a cone shaped tip face angled to parallel an upper face of said triangular segment and threaded through a closure above said triangular segment; tightening said threaded pin first causing said triangular segment to lock against said shaft and then causing said pin to move downward along said upper face of said triangular segment thereby forcing said lower head upward and acting to lock said lower head in place.

* * * * *